US005401951A

United States Patent [19]

Butler et al.

[11] Patent Number: 5,401,951

[45] Date of Patent: Mar. 28, 1995

[54] METHOD AND APPARATUS FOR OVERLOAD PROTECTION FOR A PHOTOMULTIPLIER TUBE

[75] Inventors: Neal R. Butler, Acton; Patrick J. Cobler, Belmont, both of Mass.

[73] Assignee: Loral Infrared & Imaging Systems, Inc., Lexington, Mass.

[21] Appl. No.: 68,388

[22] Filed: May 28, 1993

[51] Int. Cl.[6] ..... H01J 29/52; H01J 40/14

[52] U.S. Cl. ..... 250/207; 250/214 VT; 313/533

[58] Field of Search ..... 250/207, 214 VT; 313/104, 105, 105 CM, 103 CM, 523, 533

[56] References Cited

U.S. PATENT DOCUMENTS

| | | | |
|---|---|---|---|
| 3,435,233 | 3/1969 | Farnsworth | 250/207 |
| 3,714,441 | 1/1973 | Kreda | 250/207 |
| 3,821,546 | 6/1974 | McClenahan | 250/207 |
| 4,091,277 | 5/1978 | Doblhofer | 250/214 R |
| 4,436,994 | 3/1984 | VanVilet et al. | 250/207 |
| 4,804,891 | 2/1989 | Sweeney | 250/207 |
| 4,820,914 | 4/1989 | Allen | 313/533 |

FOREIGN PATENT DOCUMENTS

| | | | |
|---|---|---|---|
| 0155377 | 9/1985 | European Pat. Off. | 250/207 |
| 524417 | 1/1938 | United Kingdom . | |
| 1170788 | 12/1966 | United Kingdom . | |
| 1175626 | 4/1968 | United Kingdom . | |

*Primary Examiner*—David C. Nelms
*Assistant Examiner*—Stephone B. Allen
*Attorney, Agent, or Firm*—Leone & Moffa

[57] ABSTRACT

An overload protection circuit for a photomultiplier tube. A light source illuminates a photomultiplier tube which produces a signal proportional to the incoming radiation which is sent to photon counting electronics. The photon counting electronics produces a signal in proportion to the input photons to the photomultiplier tube and also provides an output to a frequency to voltage converter. The frequency to voltage converter is used to modulate a high voltage amplifier which controls the output of the photomultiplier tube. When the photon counting electronics indicate to the frequency to voltage converter that the photons produced by the photomultiplier tube exceed a predetermined maximum the high voltage amplifier reduces the gain of the photomultiplier tube. The gain of the photomultiplier tube is gradually reduced in proportion to the incident light level.

19 Claims, 4 Drawing Sheets

METHOD AND APPARATUS FOR OVERLOAD PROTECTION FOR A PHOTOMULTIPLIER TUBE

This invention relates to an overload protection circuit for a photomultiplier tube, and more particularly to an overload protection circuit that gradually reduces the gain of a photomultiplier tube when it is exposed to high light levels.

BACKGROUND OF THE INVENTION

Photomultiplier tubes are adversely affected by exposure to high light levels while operating. In many cases, the physical mechanisms responsible for these effects are not understood. The effects result in a temporary loss in sensitivity and a temporary increase in dark current. These temporary effects can persist for many hours after exposure to an intense light source. It has been determined experimentally that reducing the tube gain by reverse biasing the photocathode dramatically reduces these effects.

In U.S. Pat. No. 4,436,994 to James G. Van Vliet, and James R. Brown assigned to Beckman Instruments, Inc. of Fullerton, Calif. entitled PHOTOMULTIPLIER DETECTOR PROTECTION DEVICE AND METHOD a photomultiplier detection device is disclosed. The photomultiplier in Van Vliet utilizes a negative feedback loop to maintain a photomultiplier detector below a predetermined output. The feedback loop in Van Vliet comprises a comparator which responds to the photomultiplier output. The output of the photomultiplier is limited by a signal generated by a digital to analog converter. The voltage control signal controls the output of a power supply which is applied to the photomultiplier detector. The output of the photomultiplier detector is modulated by a high voltage power supply which is in turn modulated by a digital to analog converter using a counter as a set voltage. Van Vliet senses the output of the photomultiplier tube and not the number of photons incident upon the photomultiplier tube. Also, Van Vliet adjusts the main power supply voltage and does not adjust the voltage of the focus electrode separately. Van Vliet also does not provide a frequency to voltage converter which would be needed if incident photon frequency is measured. The photomultiplier detector protection device and method disclosed in Van Vliet depends heavily on the ability to sense a preamplified output of the photomultiplier which has fully multiplied the incoming radiation to generate an output voltage. The protection scheme of Van Vliet cannot work using photon counting electronics.

SUMMARY OF THE INVENTION

This invention is a circuit which gradually reduces the gain of a photomultiplier tube when it is exposed to high light levels. The circuit includes a frequency to voltage converter and a high voltage amplifier. The frequency to voltage converter converts the pulse train output from the photon counting circuitry to a voltage related to the input light level. If this voltage exceeds a threshold level, the difference is amplified and used to reduce the tube gain by reverse biasing the photocathode. The first working model showed a reduction in gain of between 3 and 4 orders of magnitude, with a corresponding increase in the tube tolerance to high levels before the onset of overload behavior. Recovery to normal operating conditions upon removal of the intense light source took less than 10 ms.

It is one object of the invention to provide an overload protection circuit for a photomultiplier tube that works with conventional multiplier tubes.

It is a further object of the invention to provide an overload protection circuit for a photomultiplier tube, wherein the overload protection circuit uses photon counting electronics rather than directly measuring anode current.

It is yet another object of the invention to provide an overload protection circuit for a photomultiplier tube that is intended to protect the photomultiplier tube during high light levels.

Other objects, features and advantages of the present invention will become apparent to those skilled in the art through the description of the preferred embodiment, claims and drawings herein where like numerals refer to like elements.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

Figure 1:
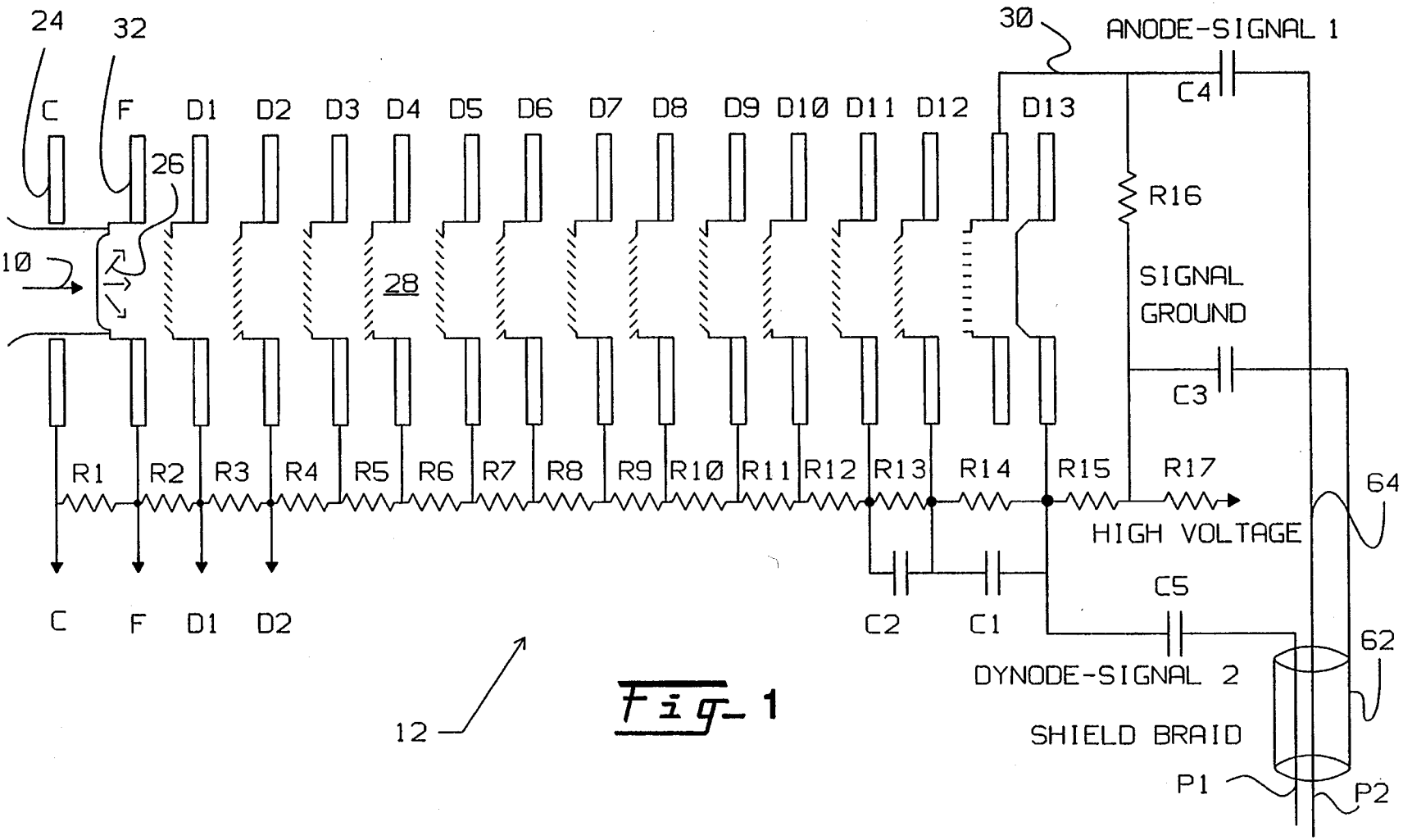
FIG. 1 shows a schematic view of a photomultiplier tube of the present invention.

Now referring to FIG. 1 which shows a schematic of photomultiplier tube 12 of the apparatus of the invention. The photomultiplier tube 12 is comprised of a photocathode 24, which absorbs incident light 10 (photons) and emits electrons 26 into the internal vacuum of the tube 12 an electron multiplier structure 28 which outputs many, typically 1,000,000, electrons for each input electron; and an anode 30 which collects the electron output of the electron multiplier structure 28.

In a venetian blind electron multiplier structure the individual electrodes are called dynodes D1–D12; a focus electrode 32 can also be used to steer photoelectrons from the photocathode 24 to the electron multiplier structure 28.

Due to the very high gain of the electron multiplier structure 28, it is practical to detect the charge pulse caused by a single photoelectron emitted from the photocathode 24 and convert the charge to a digital signal which represents the detection of a single photon. Such circuits are referred to as photon counting circuits. The rejection of low amplitude pulses from the electron multiplier structure 28 and the assignment of a standard amplitude to each pulse results in noise levels very close to the theoretical minimum, especially for extremely low light levels.

The photomultiplier tube 12 provides an anode signal 1 on signal line P2 and a dynode signal 2 on signal line P1. The signal lines are conducted on a shielded braided wire 62. The shielded braided wire 62 is grounded with signal ground 64. Signal 1 and signal 2 are now ready for signal processing.

Figure 2:
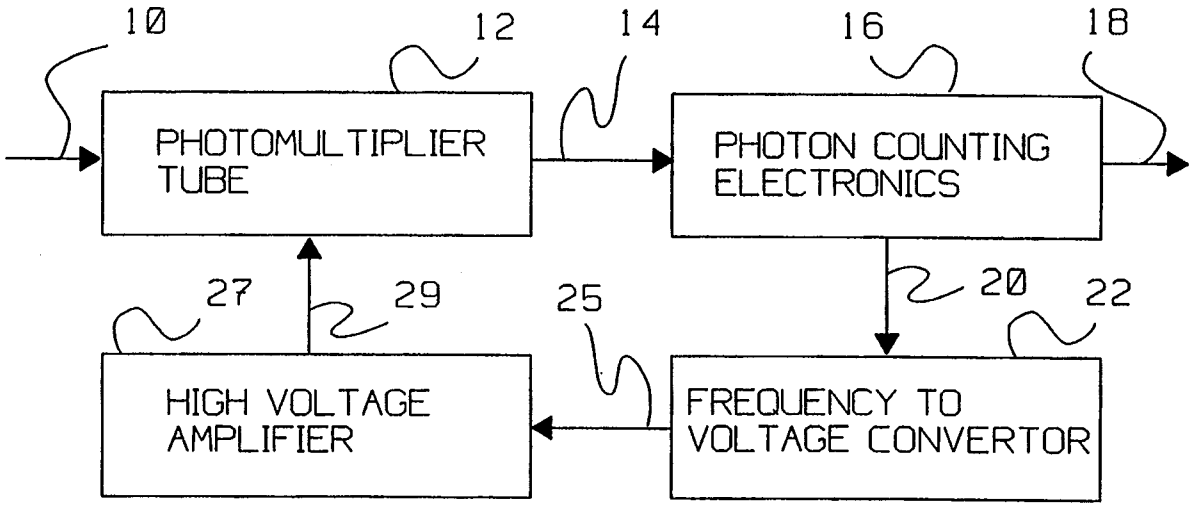
FIG. 2 shows a diagram of how the apparatus of the invention is used to protect a photomultiplier tube from an overload condition.

Now referring jointly to FIG. 1 and FIG. 2 which show the apparatus of the invention used to protect a photomultiplier tube 12 from an overload condition. Incident light 10 is shown entering the photomultiplier tube 12 and striking the photocathode 24. The photocathode 24 absorbs the incident light and emits electrons to an electron multiplier structure 28 which outputs millions of electrons for each input photon.

The output of the photomultiplier tube 12 is sent on signal line 14 to photon counting electronics 16. The photon counting electronics 16 have a signal output 18 which corresponds to the light level input to the photomultiplier tube 12. Photon counting electronics 16 also provide a high frequency output, in proportion to the input incident light 10, to frequency to voltage converter 22. The frequency to voltage converter 22 provides a control signal on line 25 to high voltage amplifier 27. High voltage amplifier controls the gain of the photomultiplier tube 12 through a gain adjust line 29. The feedback loop of the invention compares a controlled variable to a desired reference, and adjusts the tube gain by means of the control mechanism in order to maintain the control variable at or near the reference value.

Figure 3:
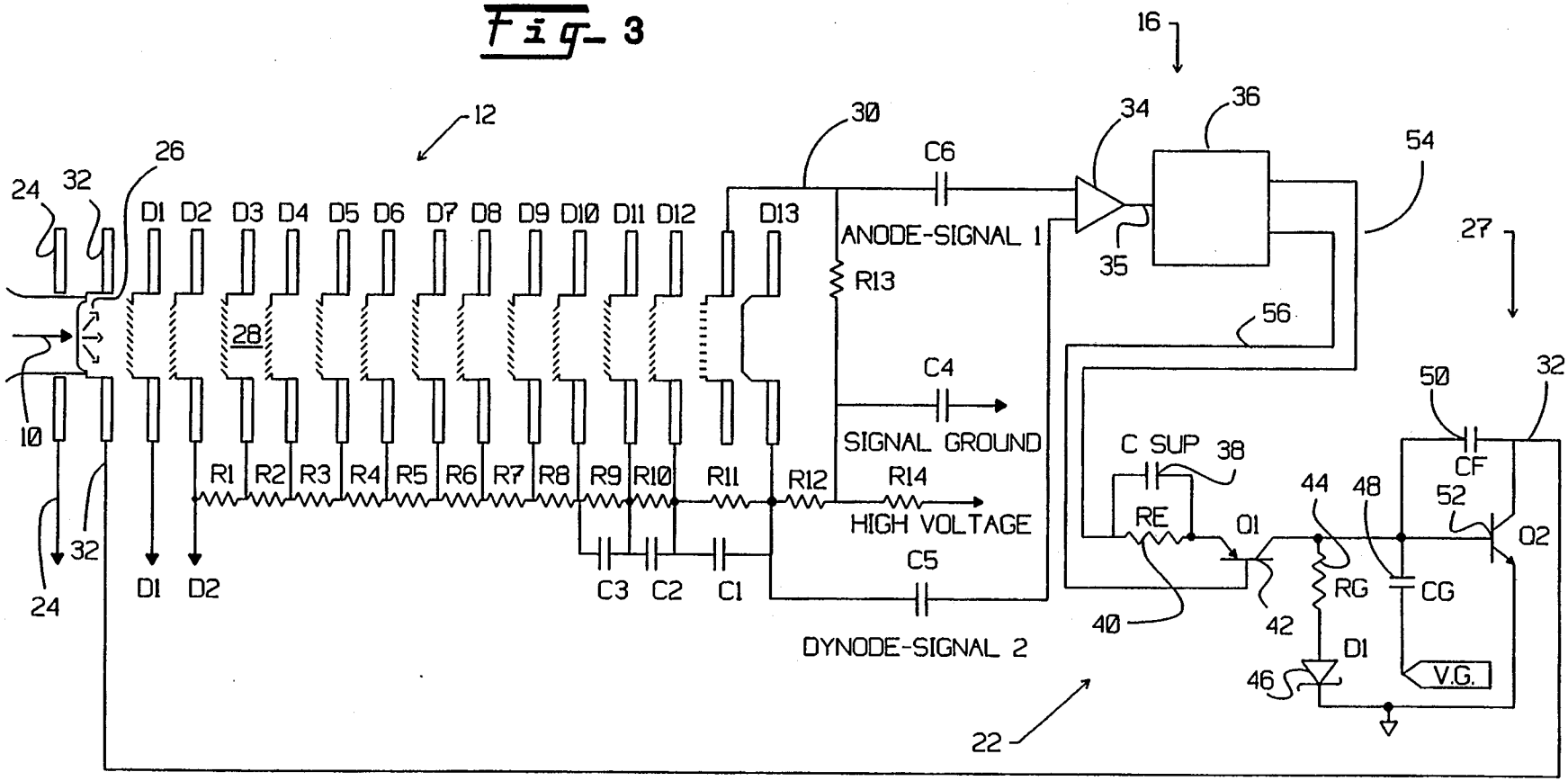
FIG. 3 shows a detailed circuit schematic diagram of a photomultiplier overload protection circuit apparatus of the invention.

Now referring to FIG. 3 which shows a detailed circuit schematic diagram of the photomultiplier overload protection circuit apparatus of the invention. The photomultiplier tube 12 is shown connected to photon counting electronics 16, the frequency to voltage converter 22, and high voltage amplifier 27.

The photon counting electronics 16 are comprised of a high frequency amplifier 34 which has two inputs, one from anode 30 and dynode 33. The output of the high frequency amplifier 34 is an analog voltage on line 35 which represents the photon pulses from the photomultiplier tube 12. The analog voltage representative of the incident light 10 is fed to discriminator 36 on the signal line 35. The discriminator 36 provides complimentary digital binary logic level outputs 54 and 56 which in one preferred embodiment of the invention are 4 and 5 volts. The complimentary output 54 provides a logic level pulse proportional to the transition of the voltage level above a predetermined level. The logic level line 54 is logically complimentary to logic level line 56. The logic level lines 54 and 56 are fed to the frequency to voltage converter 22 which provides a control signal to the high voltage amplifier 27. The logic level line 54 is fed to resistor 40 and capacitor 38 as a speed up device for a transistor 42. The complimentary signal logic level line 56 is fed to the base of transistor 52. When the base voltage is 4 volts and the emitter voltage is 5 volts the transistor 42 is turned on and capacitor 48 is charged. The short duration of the pulses to the transistor 42 requires the use of capacitor 38. The output of the transistor 42 is integrated on capacitor 48 which is charged each time a pulse is seen on the logic level line 54 that is representative of a photon pulse from the photomultiplier tube 12. The diode 46 temperature compensates the circuit.

The control of the photomultiplier tube 12 is accomplished through line 29 to the focus electrode 32. The transistor of 52 base is connected to the output of the transistor 42 and capacitor 48 and turns on when the frequency of counts coming through the discriminator 36 is above a predetermined rate. When this happens the transistor drops the focus voltage and decreases the gain of the photomultiplier tube 12.

When the voltage difference between the photocathode 24 and the focus electrode 32 is such that the cathode voltage is greater than the focus voltage, the photomultiplier tube gain is reduced by a gain factor in the range of 1000 to 10,000. If the cathode voltage is less than the focus voltage, the gain of the photomultiplier tube 12 is restored. Those skilled in the art will recognize that the cathode voltage should be greater than the first dynode voltage to achieve the best possible gain reduction. Once transistor 52 turns on, the voltage in resistor 44 does not change. Also, when transistor 52 turns on, the focus voltage is effectively grounded. Capacitor 50 determines the voltage gain after the threshold is reached. In one example of the invention capacitor 50 has a value of about 10 pF and capacitor 48 has a value of about 2200 pF.

Figure 4:
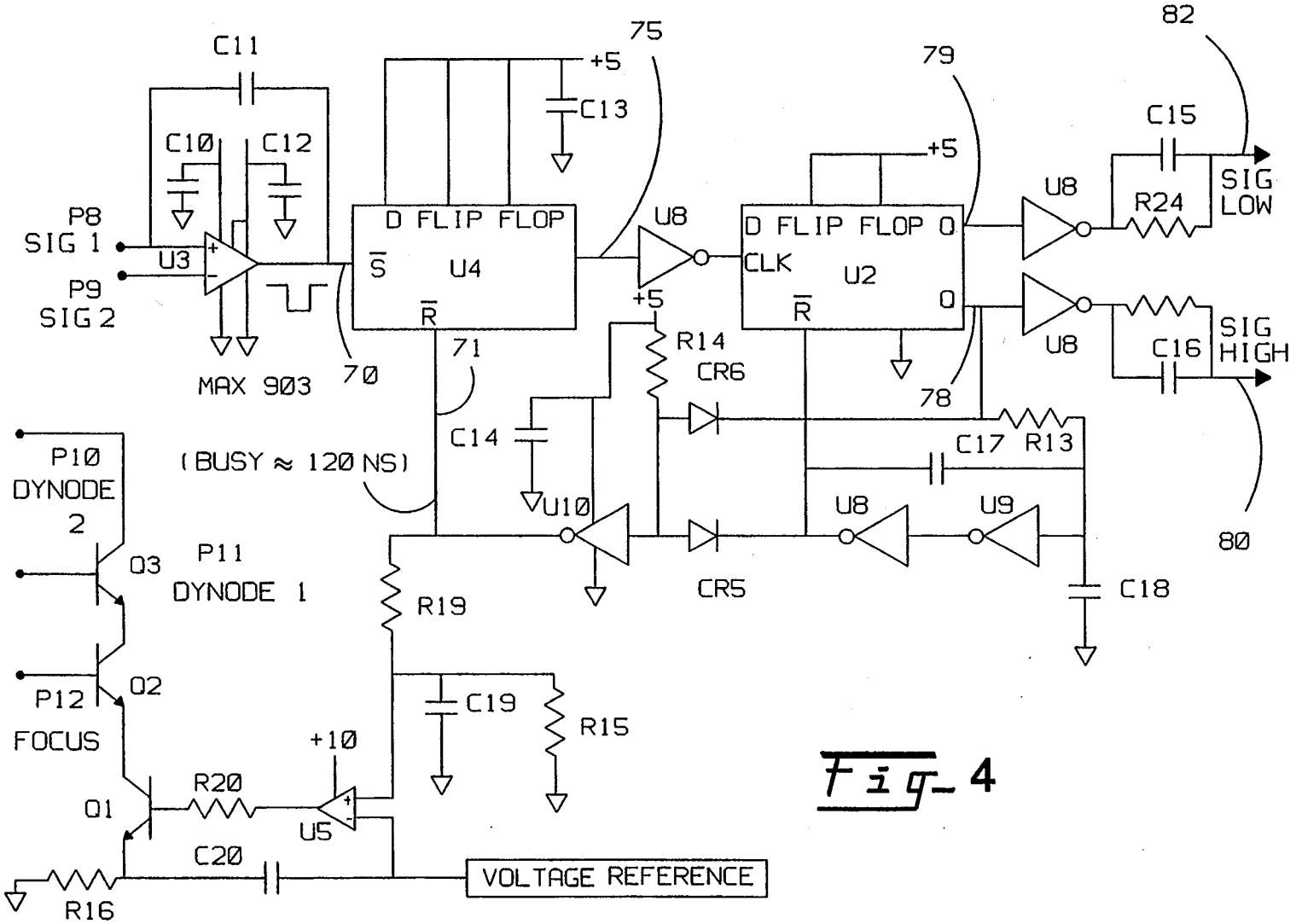
FIG. 4 shows an alternate circuit used to process the outputs of the photomultiplier tube apparatus of the present invention.

Referring now to FIG. 4, FIG. 4 shows an alternate circuit used to process the outputs of the photomultiplier tube. Signal 1 and signal 2 are fed to a comparator U3 that provides a differential output 70 indicative of the incoming photomultiplied signal. The differential output signal 70 is fed to a D flip-flop U4 that provides a logic signal 75 that is responsive to the differential output signal 70. The D flip-flop U4 is reset with a reset circuit using analog delay timing that provides for the capture of two pulses by the D flip-flops U4 and U2. The output logic signal 75 of the D flip-flop U4 is fed to invertor U8 that provides a clock signal to U2. U2 is reset by another stage of the analog reset delay timing circuit described in more detail hereinbelow.

The flip-flop U2 provides a Q and $\overline{Q}$ output on signal lines 79 and 78, respectively. These outputs are inverted and may be provided to an external apparatus as desired for further processing as the high signal 80 and low signal 82. The analog timing circuit comprises delaying invertors U8, pins 5 and 6, U9, pins 3 and 4, U10, pins 8 and 9, and their associated components. The analog timing circuit is provided with the output of $\overline{Q}$ 78 which is fed through a resistor R13 and capacitor C17 as well as to diode CR6 and delaying invertors U8 and U9. The output of the delay network at U8, pin 6 is connected to diode CR5 which provides invertor U10 with a delay signal which is presented to the input of the reset terminal 71 of D flip-flop U4.

When the reset line 71 is logic 0 this indicates a not busy state. The not busy state is entered for most of the time. The measure of the pulse rate of the delayed reset signal 71 is a measure of the number of incoming photons. The output of the timing circuit at pin 8 of U10 is connected to a first input of operational amplifier U5 where the timing circuit output is compared to a reference voltage connected to a second input of operational amplifier U5. U5 provides a gating signal at its output which gates the dynode and focus electrodes to ground through transistor Q1 and resistor R16, thus preventing overload of the photomultiplier tube.

In operation, when the control voltage of Q1 is 0, Q1 is off and the system operates normally. When the voltage from U5 reaches the supply voltage, Q1 will start to turn on and short the dynode and focus electrodes to ground through resistor R16.

Those skilled in the art will recognize that the apparatus of the invention accomplishes a means for sampling the number of photon pulses and adjusts the focus voltage to reduce the photomultiplier tube gain if the number of photon pulses exceeds a certain predetermined value. The sampling of the photon frequency may be accomplished by other means such as digital processing and the control of the focus voltage may be under control of a microprocessor controlling a high voltage amplifier.

In one alternate embodiment of the invention the photomultiplier tube 12 is constructed of either a venetian blind electron multiplier structure, or a microchannel plate electron multiplier structure.

In an additional embodiment of the invention the photomultiplier tube 12 may be constructed of more than one anode.

In yet another embodiment of the invention the anode 30 current may be used to sense a photomultiplier tube 12 overload condition.

In yet another embodiment of the invention any dynode D1–D13 current may be used to sense a photomultiplier tube 12 overload condition.

In yet another embodiment of the invention the electron multiplier current 26 may be used to sense a photomultiplier tube 12 overload condition.

In yet another embodiment of the invention the photocathode 24 bias voltage, the internal electrode voltage, focus electrode 32 voltage or any combination of the above may be used to sense a photomultiplier tube 12 overload condition.

Those skilled in the art will appreciate that the apparatus of the invention may utilize a frequency to voltage converter to count the number of generated photons and a number of series connected transistors to increase its output voltage capability.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An overload protection apparatus for a photomultiplier based sensor comprising:

(a) photomultiplier tube means for sensing a number of incident photons and producing a photon output signal in proportion to the number of incident photons sensed wherein the photomultiplier tube means further comprises a focus electrode having a gain and the photomultiplier further comprises a gain adjustable by a focus voltage;

(b) photon counting means having a photomultiplier photon input connected to the photon output signal and having a photon count output;

(c) frequency to voltage converter means for converting the number of incident photons sensed to a voltage level wherein the frequency to voltage converter means is connected to the photon count output and the frequency to voltage converter means also has a control voltage output; and (d) high voltage amplifier means for controlling the voltage gain of the photomultiplier tube in response to the control voltage output.

2. The overload protection apparatus of claim 1 wherein the photomultiplier tube means further comprises a venetian blind electron multiplier structure.

3. The overload protection apparatus of claim 1 wherein the photomultiplier tube means further comprises a microchannel plate electron multiplier structure.

4. The overload protection apparatus of claim 1 wherein the photomultiplier tube means further comprises a plurality of anodes.

5. The overload protection apparatus of claim 1 further comprising a frequency to voltage converter.

6. The overload protection apparatus of claim 1 further comprising series connected transistors to increase its output voltage capability.

7. The photomultiplier gain adjustment apparatus of claim 1 wherein the photomultiplier tube means includes an anode with an anode current and the gain of the photomultiplier tube means is lowered in response to the anode current.

8. The photomultiplier gain adjustment apparatus of claim 1 wherein the photomultiplier tube means includes at least one dynode with at least one dynode current and the gain of the photomultiplier tube means is lowered in response to at least one dynode current.

9. The photomultiplier gain adjustment apparatus of claim 1 wherein the photomultiplier tube means includes an electron multiplier means with an electron multiplier current and the gain of the photomultiplier tube means is lowered in response to the electron multiplier current.

10. The photomultiplier gain adjustment apparatus of claim 1 wherein the photomultiplier tube means includes a photocathode with a photocathode bias voltage and the gain of the photomultiplier tube means is lowered in response to the photocathode bias voltage.

11. The photomultiplier gain adjustment apparatus of claim 1 wherein the photomultiplier tube means includes an internal electrode with an internal electrode voltage and the gain of the photomultiplier tube means is lowered in response to the internal electrode voltage.

12. A photomultiplier tube protection apparatus comprising:

(a) a photomultiplier having a anode, a plurality of dynodes, and a last dynode having an output signal, wherein the photomultiplier apparatus also has a focus electrode;

(b) a high frequency amplifier for amplifying the anode signal and the output signal to generate a high frequency output signal;

(c) a discriminator to compare the high frequency output signal such that if the high frequency output signal exceeds a predetermined threshold the discriminator will produce a logic high on a first line and a complimentary logic low on a second line;

(d) a means for counting pulses on the complimentary lines such that if the means for counting exceeds a certain value it will send a signal on the first line and a complimentary signal on the second line; and (e) a means for controlling high voltage connected to receive a control signal from a means for counting, wherin the means for controlling high voltage has a voltage control output, and wherein the means for controlling high voltage is connected to the focus electrode.

13. The photomultiplier tube protection apparatus of claim 12 wherein the means for counting pulses comprises a transistor, the base of which connected to one line and the emitter of which is connected to the other line.

14. The photomultiplier tube apparatus of claim 12 wherein the high voltage control means is a voltage transistor having a base connected to the collector of the photon counting transistor.

15. The photomultiplier tube apparatus of claim 12 wherein the photomultiplier tube means further comprises a venetian blind electron multiplier structure.

16. The photomultiplier tube apparatus of claim 12 wherein the photomultiplier tube means further comprises a microchannel plate electron multiplier structure.

17. The photomultiplier tube apparatus of claim 12 wherein the photomultiplier tube means further comprises a plurality of anodes.

18. The photomultiplier tube apparatus of claim 12 further comprising a frequency to voltage converter.

19. The photomultiplier tube apparatus of claim 12 further comprising series connected transistors to increase its output voltage capability.

* * * * *